US007607459B2

(12) United States Patent
Treen, Jr.

(10) Patent No.: US 7,607,459 B2
(45) Date of Patent: Oct. 27, 2009

(54) LIQUID DISPENSER NOZZLE

(76) Inventor: John S. Treen, Jr., 102 Rue Burgundy, Slidell, LA (US) 70461

( * ) Notice: Subject to any disclaimer, the term of this patent is extended or adjusted under 35 U.S.C. 154(b) by 0 days.

(21) Appl. No.: 11/500,556

(22) Filed: Aug. 8, 2006

(65) Prior Publication Data

US 2008/0035239 A1 Feb. 14, 2008

(51) Int. Cl.
*B65B 1/04* (2006.01)
*B65D 5/72* (2006.01)

(52) U.S. Cl. ..... 141/311 A; 141/392; 222/494; 222/571

(58) Field of Classification Search ..... 141/206, 141/311 A, 392; 222/571, 494; 137/312, 137/537, 539
See application file for complete search history.

(56) References Cited

U.S. PATENT DOCUMENTS 2,004,203 A * 6/1935 Howell ..... 251/155
2,842,160 A * 7/1958 Rekettye ..... 137/565.11
2,996,077 A * 8/1961 Taggert ..... 137/537
4,060,108 A * 11/1977 Weston et al. ..... 141/59
4,062,480 A * 12/1977 Bjorklund ..... 222/571
5,094,278 A * 3/1992 Arao et al. ..... 141/311 A
5,377,729 A * 1/1995 Reep ..... 141/392
5,704,522 A * 1/1998 Orgeolet et al. ..... 222/494
6,311,742 B1 * 11/2001 Nusen et al. ..... 141/206
6,520,222 B2 * 2/2003 Carmack et al. ..... 141/311 A
7,228,870 B1 * 6/2007 Sutera et al. ..... 137/539

* cited by examiner

*Primary Examiner*—Timothy L Maust
(74) *Attorney, Agent, or Firm*—Keaty Law Firm, LLC

(57) ABSTRACT

A nozzle attachment for a conventional pump nozzle for preventing dripping or leaking of liquid after a pre-determined amount of liquid has been dispensed. The attachment is configured for telescopically mounting on a dispensing end of a standard pump nozzle. The nozzle attachment has a hollow body and a spring-mounted valve moving in the hollow body between a normally closed position and an open position, allowing a flow of liquid, such as gasoline fuel, to be dispensed through a central opening of the nozzle attachment.

10 Claims, 1 Drawing Sheet

LIQUID DISPENSER NOZZLE

BACKGROUND OF THE INVENTION

This invention relates to nozzles for use with liquid dispenser, such as gasoline dispensers, and more particularly to an attachment for a standard gas pump nozzle, which acts to prevent excess fuel remaining in the has pump nozzle from being discharged from the open end of the nozzle when the nozzle is removed from a gas tank after fueling.

When a vehicle is fueled at a standard gas station, some liquid fuel that is trapped in the nozzle downstream of the automatic shut off valve often spills by dripping from the nozzle end after the valve has cut off the fuel supply. When the nozzle is removed from the tank this small amount of fuel may spill on the ground, on the vehicle body or splash the driver's clothing.

Many industrial fields employ anti-drip devices to prevent loss and spillage of fluids from a nozzle dispenser. Many such devices propose changing the shape of the standard nozzle to reduce the liquid spillage. However, changing the shape of a standard nozzle is too costly as the gasoline industry has been employing standard dispenser nozzles for vehicle fueling for many decades. The problem of gasoline spillage persists, along with its associated problems of potential fire hazard, health concerns from evaporating fuel, as well as the danger of introducing processed hydrocarbons in the environment.

The present invention contemplates elimination of the problems associated with the convention nozzle dispensers and provision of a nozzle attachment device that has a spring-loaded check valve, which prevents dribbling of gasoline after the main shut off valve has cut the supply of dispensed fuel.

SUMMARY OF THE INVENTION

It is, therefore, an object of the present invention to provide a nozzle device for dispensing liquids from a pump.

It is another object of the present invention to provide a nozzle device with a spring-loaded check valve positioned downstream of a main shut off valve.

It is a further object of the present invention to provide an attachment device for a standard fuel dispenser nozzle that minimizes or prevents dribbling of fuel after the fuel dispensing.

These and other objects of the invention are achieved through a provision of a nozzle device, which is configured for telescopically mounting on a dispensing end of a standard pump nozzle. The nozzle device has a hollow body and a spring-activated valve moving in the hollow body between a normally closed position and an open position, allowing a flow of liquid, such as gasoline fuel, to be dispensed through a central opening of the nozzle device. Once the dispensing is finished, the valve in the nozzle device seals the central opening, preventing dripping or leaking of the liquid trapped in the nozzle device.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
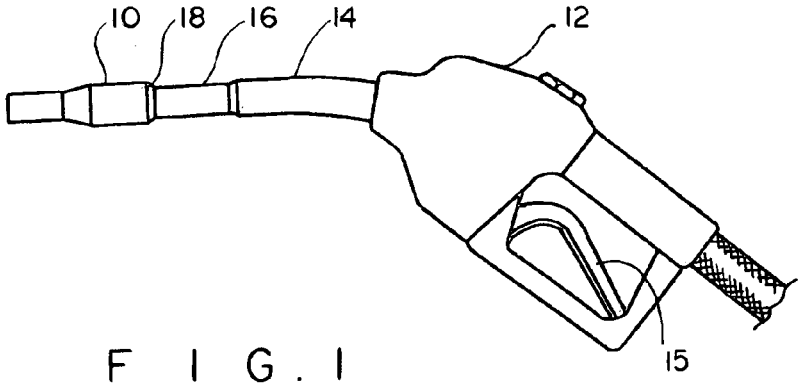
FIG. 1 is perspective view of the fuel dispensing nozzle in accordance with the present invention.
Figure 2:
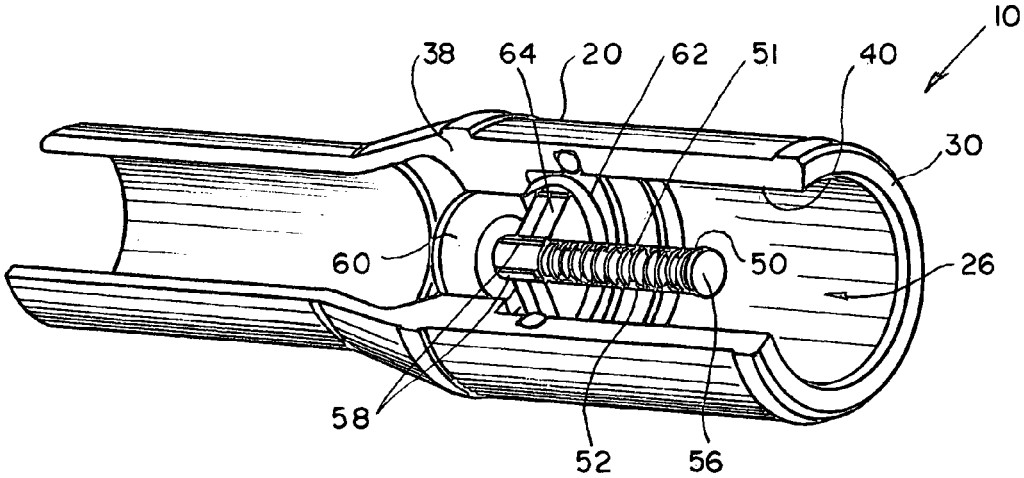
FIG. 2 is a partially cutaway view of the nozzle of the present invention and illustrating a spring loaded check valve positioned in the cylindrical portion of the nozzle body.
Figure 3:
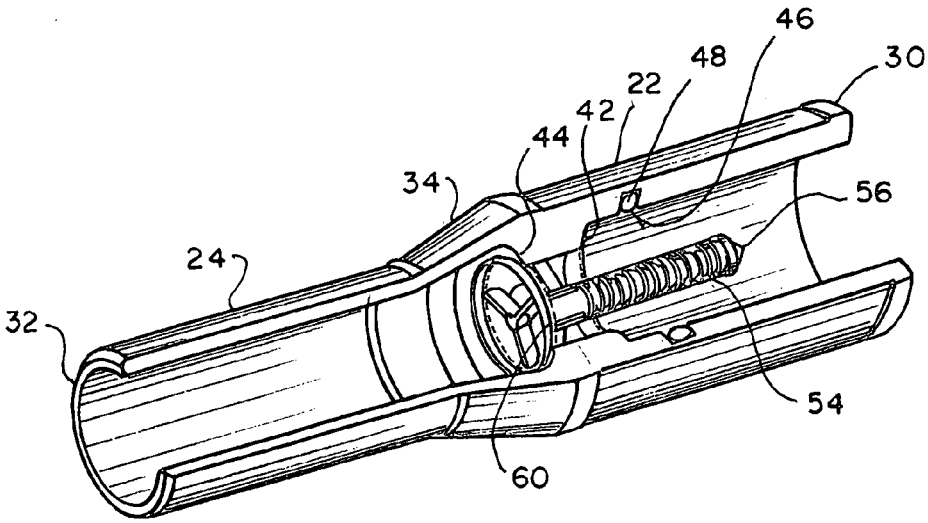
FIG. 3 is a partially cutaway view of the nozzle of the present invention and illustrating the check valve plunger.

Turning now to the drawings in more detail, numeral 10 designates the nozzle device in accordance with the present invention. The nozzle 10 is configured, sized and shaped to be mounted on a conventional gasoline pump nozzle 12. The conventional gasoline pump nozzle 12 comprises a tubular member 14 having a substantially straight cylindrical portion 16 at the outermost end thereof. A main shut off valve (not shown) is positioned inside the body of the dispenser pump nozzle 12, upstream of the nozzle 10 during liquid dispensing.

The nozzle 10 comprises a hollow body 20 having a proximate portion 22 and a distant portion 24. A through opening 26 extends from a proximate upstream end 30 to a distant dispensing end 32. The proximate portion has a generally cylindrical configuration, and the proximate end is sized and shaped to telescopically engage over a distant end 18 of the pump nozzle 12. The dispensing portion 24 is formed by a generally cylindrical portion with an external diameter substantially equal to the external diameter of the distant end 18 of a conventional pump nozzle 12. Therefore, no changes in the standard pump nozzle 12 are required. An intermediate conical portion 34 unitary connects the proximate portion 22 with the distant portion 24.

An inwardly extending flange 38 is formed on an interior wall 40 of the proximate portion 22. The flange 38 has an upstream shoulder 42 and a downstream shoulder 44. An O-ring 46 is fitted within an annular groove 48 formed in the inner wall 40 upstream of the shoulder 42 to seal an area of frictional engagement between the cylindrical portion 16 of the pump nozzle 12 and the interior wall 40 of the proximate portion 22.

A check valve 50 is positioned for axial movement within the body 20. The check valve 50 comprises a piston, or plunger body 51 having an elongated rod 52 and a compression spring 54 mounted in a surrounding relationship over at least a portion of the rod 52. A cap 56 secured to a proximate end of the rod 52 forms a stop for one end of the compression spring 54. A plurality of equidistantly spaced elongated ridges 58 are formed on an exterior of the rod 52 adjacent a distant end of the rod 52. The ridges extend in a substantially parallel relationship to the axis of the rod 52. A free end of the spring 54 urges against the ridges 58.

A valve flap member 60 is secured to a ring 62, which in turn is secured to a distant end of the rod 52. The flap member 60 is made from a resilient flexible material and is configured to seal against the inner wall of the nozzle 10 within the opening 26. A plurality of reinforcing spokes 64 extend within the ring 62. The spokes 64 are secured between the ring 62 and the rod 52 and extend radially therefrom. The valve flap member 60 normally closes the opening 26 by press fitting against the shoulder 44. The spring 54 normally urges the valve flap member 60 into a closed position, closing the central opening 26.

When a user presses on a handle 15, the main valve in the pump nozzle 12 opens, and gasoline, or other liquid flows through the pump nozzle 12 into the tubular member 14. The liquid enters the nozzle body 20, pushing on the plunger body 51 and moves the valve 50 into an open position, allowing the flow of liquid around the flap member 60. When the check valve 50 opens, the liquid flows from the proximate end 30 to the dispensing end 32. The main shut off valve automatically detects the condition when the flow of liquid must be shut off to prevent overflowing. The liquid no longer travels through the body 20 and the valve flap member 60 returns to its original position, with the flap member 60 being pulled back into its original position, closing the nozzle 10.

The nozzle 10 of the present invention does not interfere with the proper operation of the automatic shut off mechanism in the pump nozzle 12. The valve 50 does not measurably restrict the flow of liquid, such as gasoline, to affect any other aspect of the standard nozzle operation. The spring 54 and the flap member 60 do not interfere with the automatic shut off mechanism, as gasoline backing up against the valve flap member 60 reflects the same pressure against the gasoline flow acting against an upstream surface of the flap 60, thereby communicating the shut off pressure signal to the automatic shut off mechanism inside the pump nozzle 12.

The nozzle 10 of the present invention may be used with other liquid dispensing mechanisms, not necessarily equipped with the automatic shut off mechanism. In the normally closed position, the check valve 50 closes the opening 26 of the nozzle 10. In an open position, the check valve 50 provides no substantial restriction to the flow of gasoline or other liquid through the nozzle body 20. The check valve 50 captures excess liquid remaining after pump shut off and prevents spilling incidents at a gas pump.

The nozzle 10 can be frictionally secured to the cylindrical portion 16 of a standard pump nozzle 12 and remain secured on the pump nozzle 10. In the preferred embodiment, the proximate end 22 is fitted over the cylindrical portion 16 of the pump nozzle 12. Alternatively, the nozzle can be provided as an attachment to be used on demand.

Many changes and modifications can be made in the design of the present invention without departing from the spirit thereof. I, therefore, pray that my rights to the present invention be limited only by the scope of the appended claims.

I claim:

1. A liquid dispenser nozzle device for use with a fuel pump nozzle, the device comprising:

a hollow body having a central opening extending therethrough, said body being configured for positioning on a dispensing end of the pump nozzle and frictionally engaging the dispensing end of the pump nozzle; and a valve means with a valve member carried by an elongated rod and a resistance spring for normally closing the central opening, said valve means moving into an open position under the force of liquid exiting the dispensing end of the pump nozzle, said resistance spring normally urging the valve member into a normally closed position, closing the central opening, said resistance spring being mounted between a cap secured to a proximate end of the elongated rod and raised ridges formed on a distant end of the elongated rod, said ridges being oriented in parallel to a longitudinal axis of the elongated rod.

2. The device of claim 1, wherein said hollow body comprises a proximate portion configured to be secured over the dispensing end of the pump nozzle and a distant portion that is sized and shaped substantially similar to the dispensing end of the pump nozzle.

3. The device of claim 2, wherein said hollow body has an inner wall, and wherein an annular O-flag is fined in a groove formed in the inner wall in the proximate portion of the hollow body for sealing an area of attachment of the hollow body to the distant end of the pump nozzle.

4. The device of claim 3, wherein an inwardly extending annular flange is formed on said inner wall downstream from said sealing O-ring.

5. The device of claim 4, wherein said valve member is adapted for normally sealing said central opening by frictionally engaging said annular flange.

6. The device of claim 1, wherein said elongated rod comprises a distant end, and wherein said valve member is carried by the distant end of the elongated rod.

7. The device of claim 6, wherein said resistance spring is mourned over the proximate portion of the elongated rod.

8. The device of claim 7, wherein said elongated rod carries a stop member on its proximate end, said elongated rod being provided with a plurality of outwardly extending ridges adjacent the distant end.

9. The device of claim 8, wherein said spring is mounted on said elongated rod between said stop member and said ridges.

10. The device of claim 1, wherein said valve member is sized to allow a flow of liquid around said valve member when the valve means is in an open position.

* * * * *